US006957688B2

(12) United States Patent
Masui et al.

(10) Patent No.: US 6,957,688 B2
(45) Date of Patent: Oct. 25, 2005

(54) ROLL APPARATUS OF CONTINUOUS CASTER AND CYLINDRICAL ROLLER BEARING FOR SUPPORTING ROLL OF CONTINUOUS CASTER

(75) Inventors: Takashi Masui, Osaka (JP); Youichi Numada, Osaka (JP); Toshikazu Kawakami, Osaka (JP); Keiichi Miyoshi, Hiroshima (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 10/611,678

(22) Filed: Jul. 2, 2003

(65) Prior Publication Data

US 2004/0123972 A1 Jul. 1, 2004

(30) Foreign Application Priority Data

Jul. 3, 2002 (JP) ..... P. 2002-194574

(51) Int. Cl.[7] ..... B22D 11/128
(52) U.S. Cl. ..... 164/442; 164/448
(58) Field of Search ..... 164/441, 442, 164/448

(56) References Cited

U.S. PATENT DOCUMENTS 4,007,822 A * 2/1977 Scheurecker ..... 164/448
5,152,334 A * 10/1992 Gallucci ..... 164/484
5,709,261 A * 1/1998 Streubel ..... 164/454
6,520,245 B2 * 2/2003 Pleschiutschnigg et al. 164/413
6,568,460 B1 * 5/2003 Kneppe et al. ..... 164/442

FOREIGN PATENT DOCUMENTS

JP 10-291059 11/1998

* cited by examiner

*Primary Examiner*—Len Tran
(74) *Attorney, Agent, or Firm*—McGinn IP Law, PLLC

(57) ABSTRACT

A roll apparatus provided at a continuous caster for transferring a cast piece to a predetermined location includes: at least three divided rolls arranged to align concentrically and in an axial direction thereof to constitute a roll forming a cast piece transfer path. At least one end portion of at least of the divided rolls is supported by a cylindrical roller bearing of a full roller type.

22 Claims, 2 Drawing Sheets

ROLL APPARATUS OF CONTINUOUS CASTER AND CYLINDRICAL ROLLER BEARING FOR SUPPORTING ROLL OF CONTINUOUS CASTER

BACKGROUND OF THE INVENTION

The present invention relates to a roll apparatus of a continuous caster and a cylindrical roller bearing for supporting a roll of a continuous caster.

Generally, a continuous caster is provided with roll groups each comprising a set of long and short rolls arranged coaxially via bearings for pinching a cast piece which is drawn from a mold and is being transferred at upper and lower positions thereof. Plenty of the roll groups are aligned along a direction of transferring the cast piece. The roll groups are used as support rolls, guide rolls and pinch rolls as classified by functions thereof.

In order to absorb bending of the rolls accompanied by transferring the cast piece, self-aligning roller bearings or cylindrical roller bearings with aligning rings are used as bearings for rotatably supporting rolls constituting the respective roll groups around axis centers thereof.

When the self-aligning roller bearing is used as a bearing for supporting the roll attached to the continuous caster as described above, uneven wear caused by low speed and high load is liable to be produced. And when the cylindrical roller bearing with aligning ring is used, a roller having a small diameter needs to be used in a limited space in a diameter direction. Therefore, a roller diameter and a pitch circle diameter of a roller set, that is, a diameter of a circle formed by connecting centers of the rollers (P.C.D. of roller) are reduced and a load capacity of the roller bearing is also reduced.

SUMMARY OF THE INVENTION

In light of the above problems, an object of the present invention is to provide a roll apparatus having high loading capacity.

In order to solve the aforesaid object, the invention is characterized by having the following arrangement.

Aspect 1. A roll apparatus provided at a continuous caster for transferring a cast piece to a predetermined location comprising:

at least three divided rolls arranged to align concentrically and in an axial direction thereof to constitute a roll forming a cast piece transfer path, wherein at lease one end portion of at least of the divided rolls is supported by a cylindrical roller bearing of a full roller type.

Aspect 2. The roller apparatus according to the aspect 1, wherein the roll includes an upper forming roll and a lower forming roll each including at least three pieces of divided rolls having difference length in the axial direction, respectively, the upper forming roll and the lower forming roll are opposed to each other in a thickness direction of the cast piece, and an arrangement of the divided rolls of the upper forming roll and an arrangement of the divided rolls of the lower forming roll are made difference from each other.

Aspect 3. The roller apparatus according to the aspect 1, wherein a plurality of the rolls are arranged in a direction of transferring the cast piece.

Aspect 4. The roller apparatus according to the aspect 1, wherein end portions of all divided rolls are supported by cylindrical roller bearings of the full roller type.

Aspect 5. The roller apparatus according to the aspect 1, wherein each of the divided rolls is supported by an independent cylindrical roll bearing.

Aspect 6. The roller apparatus according to the aspect 1, wherein the cylindrical roller bearing includes an outer ring member with a flange supported by a roll supporting apparatus, an inner ring member arranged on an inner side of the outer ring member in a diameter direction thereof concentrically therewith and externally fitted to an end portion of the divided roll, and a plurality of pieces of cylindrical rollers rollably arranged between the outer ring member and the inner ring member.

DETAILED DESCRIPTION OF PREFERRED EMBODIMENTS

Figure 1:
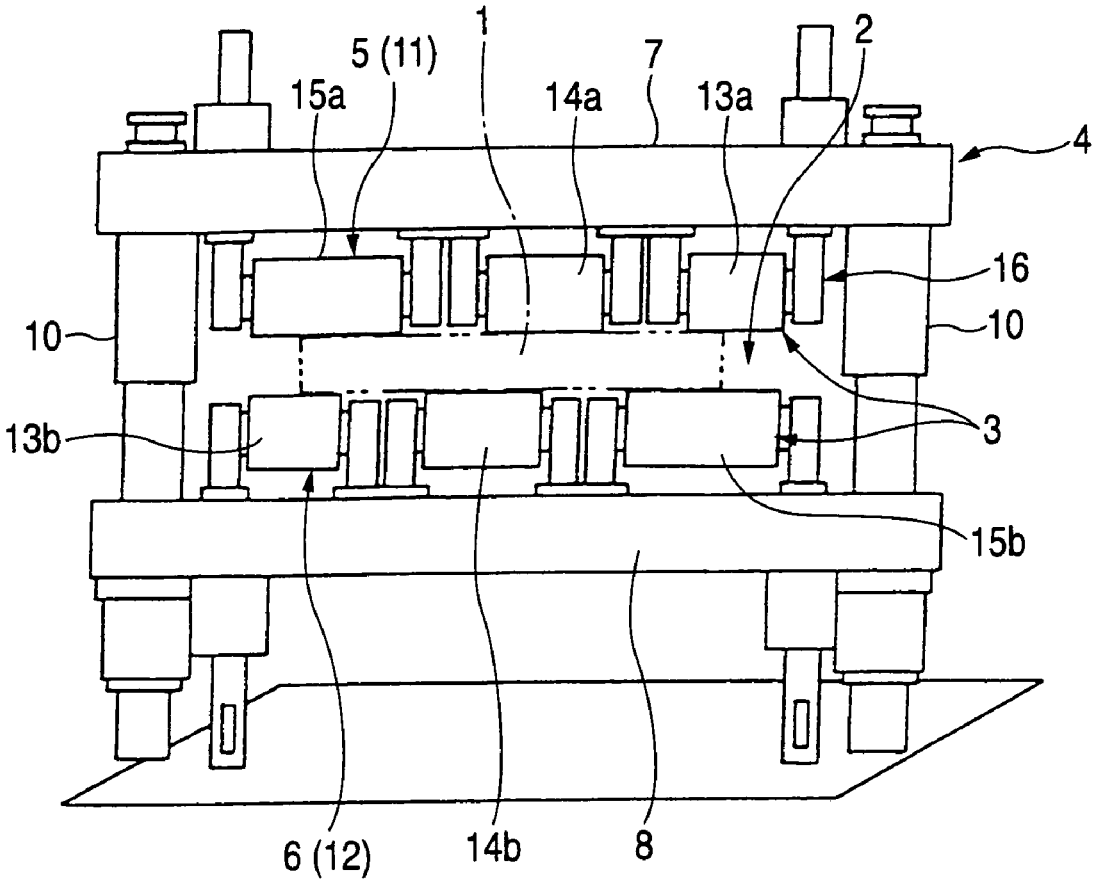
FIG. 1 is a front view of a roll apparatus of a continuous caster showing an embodiment of the invention.
Figure 2:
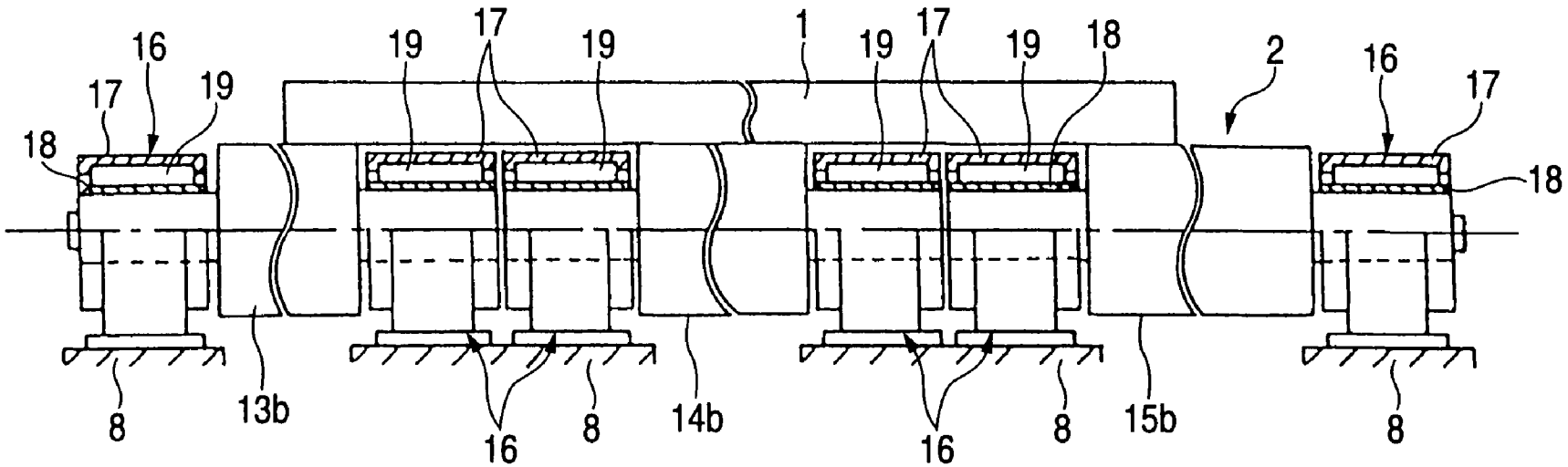
FIG. 2 is a partially broken sectional view similarly showing a cylindrical roller bearing of a lower forming roll.

A roll apparatus of a continuous caster according to an embodiment of the invention will be described with reference to the drawings as follows. FIG. 1 is a front view of a roll apparatus of a continuous caster showing an embodiment of the invention and FIG. 2 is a partially broken sectional view showing a cylindrical roller bearing of a lower forming roll.

Generally, a continuous caster carries out continuous casting operation by pouring molten steel held in a tandish into a mold and drawing, from the mold, a cast piece (also referred to as slab) 1 an outer shell of which has been solidified at inside of the mold while cooling the cast piece 1.

In order to draw the cast piece 1 from the mold while cooling the cast piece 1 in this way, the continuous caster includes forming rolls 3 such as support rolls, guide rolls, pinch rolls and the like aligned in a direction of transferring the cast piece 1 and forming a cast piece transfer path 2.

The forming rolls 3 are respectively supported by roll supporting apparatus 4. The roll supporting apparatus 4 includes: upper and lower frames 7 and 8 for respectively supporting an upper forming roll 5 and a lower forming roll 6 opposed to each other in a thickness direction (upper and down direction in the case of the drawing) of the cast piece 1; cylindrical roller bearings 16 attached to the respective upper and lower frames 7 and 8; and hydraulic cylinder apparatus 10 for adjusting a distance between the upper and lower frames 7 and 8.

Respective roll groups (upper and lower roll groups in FIG. 2) 11 and 12 constituting the respective forming rolls 3, that is, the upper forming roll 5 and the lower forming roll 6, are respectively constructed by a constitution in which respective three pieces of rolls of first rolls 13*a* and 13*b*, second rolls 14*a* and 14*b* and third rolls 14*a* and 14*b* are concentrically aligned as divided rolls having different lengths in an axial direction.

The lengths of the three pieces of rolls are the shortest in the first rolls 13*a* and 13*b* and are lengthened in an order of the second rolls 14*a* and 14*b* and the third rolls 15*a* and 15*b*. The roll group 11 of the upper forming rolls 5 and the roll group 12 of the lower forming rolls 6 are opposed to each other in the thickness direction of the cast piece 1. An arrangement sequence of the first roll 13*a*, the second roll 14*a* and the third roll 15*a* constituting the upper forming rolls 6 is opposed to an arrangement sequence of the first roll 13*b*, the second roll 14*b* and the third roll 15*b* in the axial direction.

The first rolls 13*a* and 13*b*, the second rolls 14*a* and 14*b* and the third rolls 15*a* and 15*b* are rotatable supported around the axis centers by the cylindrical roller bearings 16 respectively at two end portions thereof. FIG. 2 shows only the cylindrical roller bearing 16 for supporting the roll provided at the lower frame 8.

The cylindrical roller bearing 16 is constituted by: an outer ring member 17 with flange attached to the lower frame 8 nonrotatably around the axis center; an inner ring member 18 arranged on an inner side of the outer ring member 17 in the diameter direction concentrically therewith and externally fitted (idly fitted) to an end portion of each of the first roll 13*b*, the second roll 14*b* and the third roll 15*b*; and a plurality of pieces of cylindrical rollers 19 rollably arranged between the outer ring member 17 and the inner ring member 18.

The inner ring member 18 of each cylindrical roller bearing 16 is inserted with an end portion of each of the first roll 13*b*, the second roll 14*b* and the third roll 15*b* a diameter of which is contracted.

A plurality of the roller apparatus having such a constitution are arranged to align in the direction of transferring the cast piece 1. An arrangement sequence of the first roll 13*a*, the second roll 14*a* and the third roll 15*a* constituting the upper forming rolls 11 is opposed in the axial direction to an arrangement sequence of the first roll 13*a*, the second roll 14*a* and the third roll 15*c* constituting an adjacent upper forming rolls 11 in the direction of transferring the cast piece 1. Similarly, an arrangement sequence of the first roll 13*b*, the second roll 14*b* and the third roll 15*b* constituting the lower forming rolls 12 is opposed in the axial center direction to an arrangement sequence of the first roll 13*b*, the second roll 14*b* and the third roll 15*b* constituting an adjacent lower forming rolls 12 in the direction of transferring the case piece 1. Thereby, the cast piece 1 can be prevented from producing a streak-like defect in transferring the cast piece 1.

According to the continuous caster having the above-described constitution, the thickness of the cast piece 1 to be produced is adjusted by adjusting the distance between the upper and lower frames 7 and 8 by driving the hydraulic cylinder apparatus 10. Meanwhile, according to the invention, each forming roll 3 is divided into three pieces of the first roll 13*a* or 13*b*, the second roll 14*a* or 14*b* and the third roll 15*a* or 15*b*. Thereby, when the cast piece 1 is transferred to a predetermined location by pinching the cast piece 1 by the first rolls 13*a* and 13*b*, the second rolls 14*a* and 14*b* and third rolls 15*a* and 15*b* in operating the continuous caster, amounts of elongation of the first rolls 13*a* and 13*b*, the second rolls 14*a* and 14*b* and third rolls 15*a* and 15*b* by thermal expansion become small. Further, a bending amount produced by a load operated from the cast piece 1 in transferring the cast piece 1 for adjusting the thickness of the cast piece 1 becomes also small.

Therefore, support of each forming roll 3 can be dealt with even by using the cylindrical roller bearing 16 having a simple constitution as described above without using a bearing having aligning performance of a self-aligning roller bearing, a cylindrical roller bearing with aligning ring or the like.

Therefore, P.C.D. can be made larger than that in the case of using the self-aligning roller bearing and a number of pieces of the cylindrical rollers 19 and the diameter of the cylindrical roller 19 can be increased by that amount. Thereby, a rolling capacity of the bearing can be increased and transfer of the cast piece 1 can firmly carried out over a longer period of time (longer hours) than in the conventional art.

Further, an outer peripheral face of the cylindrical roller 19 using the above-described embodiment may be subjected to crowning in consideration of a loading condition. Thereby, edge load at an end face portion of the contact portion of the cylindrical roller 19 can be prevented from being produced and rolling operation of the cylindrical roller 19 can smoothly be carried out.

Further, according to the above-described embodiment, with respect to all of the forming rolls 3 of the support rolls, the guide rolls and the pinch rolls, each of the roll groups 11 and 12 is divided into three pieces of the first roll 13*a* or 13*b*, the second roll 14*a* or 14*b*, and the third roll 15*a* or 15*b* and lengths thereof are respectively made to differ from each other.

The invention is not limited thereto but there is conceivable a case in which the invention is applied to the cylindrical roller bearing 16 in any necessary roll of the support roll, the guide roll and the pinch roll.

Although according to the above-described respective embodiments, as the bearings for rotatably supporting the first rolls 13*a* and 13*b*, the second rolls 14*a* and 14*b* and the third rolls 15*a* and 15*b*, all of the bearings for supporting the two side end portions are constituted by the bearings 16. However, depending on cases, there may be constructed a constitution in which the cylindrical roller bearing 16 according to the invention is used only for either one of the bearings and a self-aligning roller bearing is used for other thereof.

On the other hand, there is conceivable a constitution in which as bearings for supporting the rolls in either one of the roll groups 11 and 12 in the two roll groups 11 and 12, the cylindrical roller bearings 16 are used in place of self-aligning roller bearings. Also in this case, operation and effect similar to those of the above-described embodiments can be achieved.

As is apparent from the above-described explanation, according to the invention, by dividing the roll for transferring the cast piece of the continuous caster into three or more pieces thereof, the cylindrical roller bearings of full roller type can be used as bearing for supporting the rolls, and a loading capacity can be increased thereby.

What is claimed is:

1. A roll apparatus provided at a continuous caster for transferring a cast piece to a predetermined location comprising:

at least three divided rolls arranged to align concentrically and in an axial direction thereof to constitute a roll forming a cast piece transfer path, wherein at least one end portion of at least one of the divided rolls is supported by a cylindrical roller bearing of a full roller type, said cylindrical roller bearing comprising:

an outer ring member, having a cylindrical outer diameter surface;

an inner ring member; and a plurality of cylindrical rollers rollably arranged between the outer ring member and the inner nine member, wherein the outer ring member comprises an integral one piece member comprising a surface contacting with said cylindrical roller and a cylindrical outer circumferential surface.

2. The roll apparatus according to claim 1, wherein the upper forming roll and the lower forming roll are opposed to each other in a thickness direction of the cast piece, and wherein an arrangement of the divided rolls of the upper forming roll and an arrangement of the divided rolls of the lower forming roll are made different from each other.

3. The roll apparatus according to claim 1, wherein the at least three divided rolls are arranged in a direction of transferring the cast piece.

4. The roll apparatus according to claim 1, wherein end portions of all of the divided rolls are supported by cylindrical roller bearings, said cylindrical roller bearings comprising full roller type bearings.

5. The roll apparatus according to claim 1, wherein each of the divided rolls is supported by an independent cylindrical roller bearing.

6. The roll apparatus according to claim 1, wherein said outer ring member comprises a flange supported by a roll supporting apparatus.

7. A roll anparatus provided at a continuous caster for transferring a cast Piece to a predetermined location comprising:

at least three divided rolls arranged to aling concentrically and in an axial direction thereof to constitute a roll forming a cast piece transfer path, wherein at least one end portion of at least one of the divided rolls is supported by a cylindrical roller bearing of a full roller type, said cylindrical roller bearing comprising an outer ring member having a cylindrical outer diameter surface, said outer ring member comprising a flange supported by a roll supporting apparatus, and wherein the cylindrical roller bearing further comprises:

an inner ring member arranged on an inner side of the outer ring member in a diameter direction thereof concentrically therewith and externally fitted to an end portion of each of the divided rolls.

8. A roll apparatus provided at a continuous caster for transferring a cast piece to a predetermined location, said apparatus comprising:

a roll comprising an upper forming roll and a lower forming roll each including at least three divided rolls, each of said divided rolls having a different length in the axial direction, wherein said divided rolls are arranged to align concentrically and in an axial direction, and wherein at least one end portion of at least one of the divided rolls is supported by a cylindrical roller bearing, said cylindrical roller bearing comprising: an outer ring member, having a cylindrical outer diameter surface;

an inner ring member; and a plurality of cylindrical rollers rollably arranged between the outer ring member and the inner ring member.

wherein the outer ring member comprises an integral one piece member comprising a surface contacting with said cylindrical roller and a cylindrical outer circumferential surface.

9. The roll apparatus according to claim 8, wherein said cylindrical roller bearing comprises a full roller type roller bearing.

10. The roll apparatus according to claim 8, wherein each of said at least three divided rolls comprises at least a first roll, a second roll, and a third roll.

11. The roll apparatus according to claim 10, wherein the first roll comprises a shortest length and the third roll comprises a longest length.

12. The roll apparatus according to claim 10, wherein an arrangement sequence of the first roll, the second roll and the third roll of the upper forming roll is opposite to an arrangement sequence of the first roll, the second roll and the third roll.

13. The roll apparatus according to claim 8, wherein said an outer ring member comprises a flange supported by a roll supporting apparatus.

14. A roll apparatus provided at a continuous caster for transferring a cast piece to a predetermined location, said apparatus comprising:

a roll comprising an upper forming roll and a lower forming roll each including at least three divided rolls, each of said divided rolls having a different length in the axial direction, wherein said divided rolls are arranged to align concentrically and in an axial direction, wherein at least one end portion of at least one of the divided rolls is supported by a cylindrical roller bearing, wherein said outer ring member comprise a flange sunnorted by a roll supporting apparatus, and wherein the cylindrical roller bearing further comprises:

an inner ring member arranged on an inner side of the outer ring member in a diameter direction thereof concentrically therewith and externally fitted to an end portion of each of the divided rolls.

15. The roll apparatus according to claim 14, wherein the cylindrical roller bearing further comprises:

a plurality of pieces of cylindrical rollers rollably arranged between the outer ring member and the inner ring member.

16. The roller apparatus according to claim 14, wherein the inner ring member of each cylindrical roller bearing is inserted with an end portion of each of the first roll, the second roll and the third roll.

17. The roll apparatus according to claim 8, further comprising:

a hydraulic cylinder apparatus for adjusting the distance between the upper forming roll and the lower forming roll.

18. The roll apparatus according to claim 1, wherein each of said at least three divided rolls comprises at first roll, a second roll and a third roll, wherein said first roll comprises a shortest length and the third roller comprises a longest length.

19. The roll apparatus according to claim 1, wherein each of said at least three divided rolls comprises a first roll, a second roll and a third roll, wherein the lengths of the three pieces of rolls are the shortest in the first roll and are lengthened in an order of the second roll and the third roll in an axial direction.

20. The roll apparatus according to claim 8, wherein each of said at least three divided rolls comprises a first roll, a second roll and a third roll, wherein the lengths of the three pieces of rolls are the shortest in the first roll and are lengthened in an order of the second roll and the third roll in an axial direction.

21. A roll apparatus provided at a continuous caster for transferring a cast piece to a predetermined location comprising:

at least three divided rolls arranged to align concentrically and in an axial direction thereof to constitute a roll forming a cast piece transfer path, wherein at least one end portion of at least one of the divided rolls is supported by a cylindrical roller bearing of a full roller type, wherein the cylindrical roller bearing comprises:

an outer ring member with a flange supported by a roll supporting apparatus;

an inner ring member arranged on an inner side of the outer ring member in a diameter direction thereof concentrically therewith and externally fitted to an end portion of the divided roll; and a plurality of pieces of cylindrical rollers rollably arranged between the outer ring member and the inner ring member.

22. A roll apparatus provided at a continuous caster for transferring a cast piece to a predetermined location comprising:

at least three divided rolls arranged to align concentrically and in an axial direction thereof to constitute a roll forming a cast piece transfer path, wherein at least one end portion of at least one of the divided rolls is supported by a cylindrical roller bearing of a full roller type, wherein the cylindrical roller bearing comprises:

an outer ring member with a flange supported by a roll supporting apparatus;

an inner ring member arranged on an inner side of the outer ring member in a diameter direction thereof concentrically therewith and externally fitted to an end portion of the divided roll; and a plurality of pieces of cylindrical rollers rollably arranged between the outer ring member and the inner ring member.

* * * * *